US005782298A

United States Patent [19]

Alexander et al.

[11] Patent Number: 5,782,298

[45] Date of Patent: Jul. 21, 1998

[54] RETRIEVABLE SAFETY PACKER

[75] Inventors: G. Timmins Alexander, Metairie; Terry L. Boquet, Chauvin, both of La.

[73] Assignee: Alexander Oil Tools, Inc., Metairie, La.

[21] Appl. No.: 660,527

[22] Filed: Jun. 7, 1996

[51] Int. Cl.[6] ..... E21B 33/122; E21B 33/127

[52] U.S. Cl. ..... 166/133; 166/138; 166/188; 166/191

[58] Field of Search ..... 166/133, 138, 166/139, 188, 191, 196

[56] References Cited

U.S. PATENT DOCUMENTS

| | | | |
|---|---|---|---|
| 2,131,275 | 9/1938 | Crickmer | 166/138 |
| 2,799,346 | 7/1957 | Baker et al. | 166/133 X |
| 3,308,886 | 3/1967 | Evans et al. | 166/138 X |
| 3,338,308 | 8/1967 | Elliston et al. | 166/138 X |
| 3,409,085 | 11/1968 | Oliver | 166/138 |
| 4,458,751 | 7/1984 | Haynes | 166/133 |
| 4,548,264 | 10/1985 | Manderscheid | 166/139 |
| 4,627,491 | 12/1986 | Zunkel | 166/133 X |

*Primary Examiner*—Geroge A. Suchfield
*Attorney, Agent, or Firm*—Keaty Patent Firm

[57] ABSTRACT

The invention relates to a safety packer assembly for use in a cement-lined pipe. The assembly provides for the use of a packer body which carries one or more resilient collars that expand in response to a compression force created by rotation of an upper part of the packer body. A safety valve is provided in the upper part of the packer body to prevent escape of the downhole pressure. A safety centralizer is detachably secured to a lower part of the packer body, the centralizer being provided with a plurality of arcuate resilient members which extend along the length of the centralizer body and frictionally contact the wall of the cement-lined pipe to maintain the packer body in its predetermined position within the pipe and resist rotation of a lower part of the packer body when the upper part is rotated.

13 Claims, 1 Drawing Sheet

RETRIEVABLE SAFETY PACKER

BACKGROUND OF THE INVENTION

This invention relates to a well mining industry, and more particularly, to an instrument designed to act as a plug in a production pipe while installing or removing blow out preventors on new or re-worked wells.

Conventionally, a packer is set close to the surface, about 15 feet from the surface when blow out preventors are removed, or when the well has to be worked over following a production. The conventional packers have inflatable collars, they are lowered by a wire line into the well and are set at a predetermined depth. The procedure of setting such a packer is relatively expensive and requires special trained personnel to come out to the site and position the packer in just the right location in a wellbore. The present invention contemplates provision of a retrievable safety packer designed to be installed in a cement-lined pipe in an easy and inexpensive manner while the blow out preventors are taken off to complete a new well, or work over an existing sulphur well.

SUMMARY OF THE INVENTION

It is, therefore, an object of the present invention to provide a safety packer which can be set and retrieved from the surface.

It is another object of the present invention to provide a retrievable safety packer specifically designed for use in a cement-lined pipe.

It is a further object of the present invention to provide a safety packer designed to increase safety of the operation by providing a check valve assembly as part of the safety packer design.

These and other objects of the invention are achieved through a provision of a packer assembly which is adapted for use in a cement-lined drill pipe suitable for use in a well mining operation. The packer assembly comprises an elongated packer body adapted for detachable engagement with a safety centralizer. The packer body is comprised of an elongated mandrel with a central opening extending through the entire length of the mandrel, an upper annular part mounted in a circumferential relationship about at least a portion of the mandrel and a lower annular part which is mounted in a circumferential relationship about the mandrel a distance from the upper part.

One or more flexible resilient collars are positioned about the mandrel between the upper part and the lower part. The collars expand in response to a compression force created by torque applied to an upper part of the packer body, while the lower part and the safety centralizer remain in a fixed position in relation to the inner wall of the pipe.

The safety centralizer is provided with a plurality of resilient members which extend through substantially entire length of the centralizer body and are secured to an exterior surface thereof. The resilient members can be made as arcuate leaf springs which contact the cement wall of the lining inside the pipe and resist rotation of the lower part. The centralizer also prevents dropping of the safety packer downhole due to frictional contact of the leaf springs with the cement-lining.

A pressure valve is mounted in the upper part of the packer body to prevent escape of downhole pressure. The valve comprises a cylindrical body with a central opening aligned for fluid communication with a central aperture of the mandrel. A ball valve element is urged into a normally seated position inside the opening of the valve body, closing the opening in the valve body, thereby preventing movement of liquid through the mandrel body upwardly. By unseating the valve member, with the help of a running and retrieving tool, the release of downhole pressure can be accomplished when the packer assembly needs to be retrieved.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
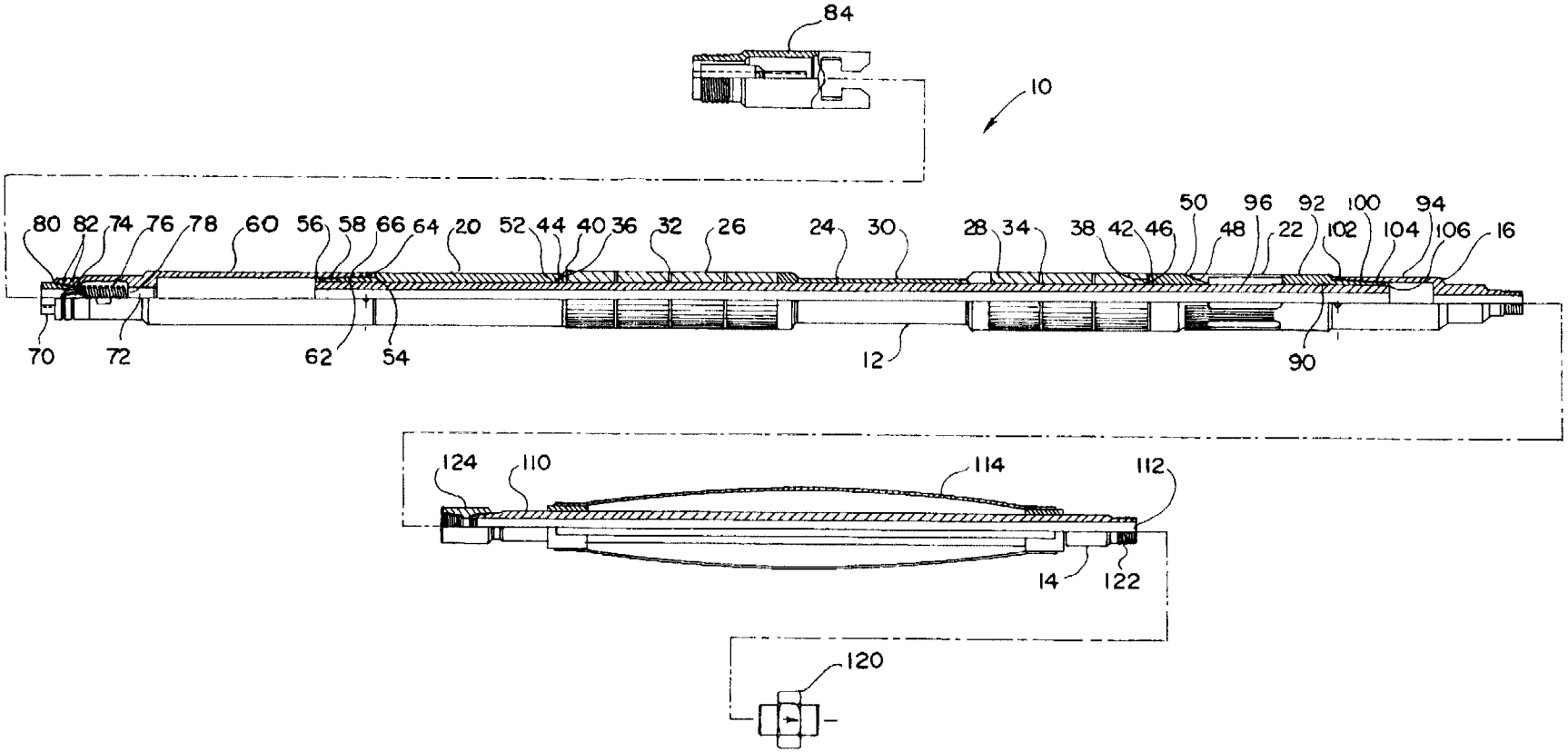
FIG. 1 is a partially cross-sectional view of the safety packer in accordance with the present invention.

Turning now to the drawing in more detail, numeral 10 designates a retrievable safety packer in accordance with the present invention. The packer assembly comprises a packer body 12 and a safety centralizer 14 adapted for a threadable engagement with a bottom sub 16 of the packer body 12. The packer body 12 has an elongated tubular shape suitable for lowering into small diameter pipes.

The packer body 12 comprises an upper part 20 and a lower part 22 mounted in a circumferentially surrounding relationship about a central mandrel 24. A pair of inflatable resilient flexible collars 26 and 28 are mounted in a surrounding relationship about the mandrel 24 adjacent the upper part 20 and the lower part 22, respectively. A spacer element 30 extends between the collars 26 and 28 and retains the collars in a spaced-apart relationship to each other.

Each collar 26 and 26 is provided with one or more intermediate back-up rings 32 and 34 respectively, which extend through the thickness of the collars 26 or 28 and contact the exterior surface of the mandrel 24. End back-up ring 36 is mounted above the collar 26, and a similar end back-up ring 38 is mounted below the collar 28. A bearing 40 is positioned in a contact relationship with the end ring 36, and a similar bearing 42 is positioned adjacent the end ring 38 on the opposite side from the collar 28. The bearing 40 and 42 are made from friction resistant material, for example Teflon®. A suitable sealing element, such as an O-ring 44 is fitted between the upper part 20 and the bearing 40, and a similar sealing element, such as an O-ring 46, is fitted between the collar 28 and a conical member 50, 5o as to prevent escape of fluids.

The upper part 20 is provided with a groove, within which an additional inner O-ring 52 is positioned. The upper part 20 is threadably engaged, such as at 54, with the central mandrel 24, and a suitable lock ring 56 is provided at the uppermost end of the upper part 20, the ring being set in position by a suitable set screw 58 located in an immediate proximity to the ring. A top sub 60 is threadably engaged, such as at 62, to the upper part 20 and is secured thereto through the use of a set screw 64. A suitable O-ring 66 is fitted between the top sub 60 and the upper part 20 adjacent the threaded connection 62. A bearing made from a friction resistant material, for example Teflon ® (not shown) is fitted between the O-ring 66 and the set screw 58.

The top sub 60 is provided with a pressure valve 70 mounted in an uppermost part of a central opening 72 formed in the top sub 60. The pressure valve comprises a ball element 74 seated in the opening 72 and urged into a contact with a conical seat formed on the interior of the opening 72 by a compression Spring 76. The opposite end of the spring 76 urges against an inwardly extending shoulder 78 formed in the opening 72.

An O-ring 80 is fitted between the top sub 60 and the body of the pressure valve 70. One or more O-rings 82 are fitted into an exterior groove formed on the outer circumference of the top sub 60 to facilitate a sealed engagement with a packer running tool 84 which engages the top sub 60 in that portion thereof, where the pressure valve 70 is secured. The pressure valve 70 allows to relieve any pressure which might have built up during production of sulphur, and equalize pressure below the packer assembly 10 and above it. When it becomes necessary to retrieve the packer assembly 10, the pressure valve 70 allows to relieve the pressure that might have built up during the production process and ensures safety of the packer retrieval. The pressure valve 70 permits circulation back through the packer downhole and selectively releases pressure from below the packer.

A lower part 22, similar to the upper part 20, is threadably engaged with the central mandrel 24 by suitable threads 90 and is mounted in a circumferential relationship about at least a portion of the mandrel 24. An inner O-ring 92 is fitted between the lower part 22, and the mandrel 24, and another O-ring 94 is mounted adjacent an opposite end, at the point of engagement between the mandrel 24 and the lower part 22. An opening 96 formed in the lower part 22 is provided with an outwardly flaring portion 98. The angle of the tapered wall 98 complements the tapered outer surface of the conical element 50, allowing the lower portion 22 to move against the conical member 50 and apply an upwardly directed force to the collar 28. When the packer body 12 is rotated, the collars 26 and 28 become squeezed, or compressed. They expand within the inner diameter of the pipe and contact the wall of the pipe, creating a plug above the blowout preventors.

The bottom sub 16 is threadably engaged, such as at 100, to the lower part 22 on the end opposite the collar 28. A set screw 102 allows fixed engagement of the bottom sub 16 and the lower part 22. A lock ring 104 is mounted in a circumferential relationship about the lower part 22 and the interior wall of the bottom sub 16. A suitable lock ring set screw 106 permits fixed engagement of the ring 104 in the desired location. A bearing made from a friction resistant material, for example Teflon ® (not shown) is fitted between the O-ring 94 and the lock ring 104.

Threadably engaged with the end of the bottom sub 16 is a safety centralizer 14 which comprises an elongated cylindrical body 110 formed with a central opening 112 therethrough. A plurality of arcuate leaf springs 114 are securely attached to the exterior of the centralizer body 110 and extend on the outside of the body 110 along substantially entire length thereof. The leaf springs 114 are formed from narrow strips of resilient material, such as thin metal. The leaf springs 114 are curved outwardly to allow contact of the centralizer with the cement lined wall of a production pipe where the packer assembly 10 is positioned.

The safety centralizer 14 performs a dual function: it holds the lower portion of the packer in position when the packer body 12 is turned to squeeze the rubber collars 26 and 28. As the packer body 12 is rotated, the leaf springs 114 provide enough friction and resistance to prevent the lower part of the packer body 12 to be rotated, thereby allowing to decrease the distance between the collars 26 and 28. Where conventional packers use numerous hook elements to engage the cemented wall of the lining which may cause damage to the cement wall, the centralizer 14, being provided with the leaf springs 114, will cause no damage to the cement lining when the upper part 20 is rotated.

If desired, the leaf springs 114 can be provided with elongated groove and ridges extending along the length of the outer surface to increase friction between the cement wall and the leaf springs 114. At the same time, the vertical ridges do not offer such friction against the cement lining 50 as to cause damage to it, as the hook elements of conventional packers do.

The second function that is performed by the centralizer 14 is prevention of the packer assembly 10 from dropping down the wellbore in the event that an operator accidentally releases the packer prematurely or applies too much torque trying to either set or release the packer assembly 10. In fact, the safety centralizer supports the weight of the packer body 12 in the desired location within the cement lined pipe of a wellbore.

A rupture disk holder 120 is threadably engaged to an end 122 of the centralizer 14 opposite the end 124 which engages the safety centralizer 14 to the bottom sub 16. The ruptured disk holder 120 can be attached to the centralizer 14 when it is desired to test a blowout preventor or the well head from above the packer.

During a conventional cement lining of a pipe, a joiner pipe is rotated while the cement slurry is hardening. The resultant interior surface of a finished joint of a cement-lined pipe is somewhat irregular and is not entirely smooth. As a result, the conventional retrievable packers do not reliably seal off the sulphur production, or the well production when blowout preventors are installed or removed in a new well, or during a workover of an existing well.

One alternative has been the use of expensive balloon-type inflatable packers which can be installed by specially trained personnel. These packers can operate in the cement-lined pipes with uneven interior surface.

The present invention provides an inexpensive solution to a long-existing problem. The packer assembly 10 can be run with a two-inch pipe and set by right hand rotation which causes compression of the resilient collars. The collars fill the annulus between the packer body and the cement lining. The tool comprises a check valve to prevent flow from the well, while any pressure below the tool can be bled off through application of a downward port on a setting tool. The packer assembly 10 also allows pumping of fluid through the tool, particularly heavier fluids, to kill the well, if necessary.

The packer assembly 10 of the present invention serves as a plug in a wellbore, particularly one that is lined with cement, to allow retrieval or positioning of blow out preventors, or workover of a well. The packer assembly 10 can be set and retrieved by the packer running tool 84 by lowering it into the pipe from the surface. Sometimes, it will be necessary to clean the portion of the cement lining where the packer will be set, so as to assure a debris-free area. The packer body 12 is equipped with expandable resilient collars 26 and 28 which can be of a different diameter to accommodate requirements of various diameter pipes.

During positioning, the safety centralizer is engaged with the packer body 12, and a rupture disk holder 120 is secured to the centralizer 14. Then the packer running tool 84 is coupled by snapping which the packer body 12, and the packer assembly 10 is ready to be lowered into a cement lined pipe. Once the packer body 12 is set in the desired location within the pipe, the running tool 84 can be disconnected and removed from the wellbore.

When it is necessary to retrieve the packer assembly 10, the running tool 84 is again lowered into the wellbore, engaged with the sub 60 and pulled to the, surface, retrieving the packer body 12 and the safety centralizer 14. The packer assembly 10 can be disassembled, cleaned, inspected and replaced, if necessary, on the surface. Once re-assembled, the packer can be lowered again into the cement lined pipe and left there for a number of years.

Many changes and modifications can be made in the design of the present invention without departing from the spirit thereof. We, therefore, pray that our rights to the present invention be limited only by the scope of the appended claims.

I claim:

1. A packer assembly for use in a well mining operation, comprising:

an elongated packer body having a central opening extending through substantially entire length of the packer body, an upper part and a lower part;

a centralizer element detachably secured to the lower part of the packer body; and a normally seated pressure valve mounted in a top of said central opening to prevent escape of a downhole pressure.

2. The assembly of claim 1, wherein said centralizer element comprises a plurality of resilient members secured on an exterior surface of an elongated mandrel, said resilient members being adapted to frictionally engage an inner wall of a pipe receiving the packer assembly therein and prevent rotation of said lower part when torque is applied to said upper part.

3. The assembly of claim 2, wherein each of said resilient members comprises an arcuate leaf spring extending along substantially entire length of said mandrel.

4. The assembly of claim 1, wherein said pressure valve comprises a cylindrical valve body having a central opening extending therethrough, a spherical valve member mounted in said central opening and a compression spring urging said valve member into a seated position against a valve seat formed on an inner wall of the central opening of the valve body.

5. The assembly of claim 1, further comprising at least one flexible resilient annular collar mounted between said upper part and said lower part of the packer body, said at least one annular collar increasing its diameter in response to a compression force created by rotation of said upper part in relation to said lower part.

6. The assembly of claim 1, further comprising a pair of flexible resilient annular collars mounted in a spaced-apart relationship to each other between said upper part and said lower part of the packer body, said collars increasing their diameters in response to a compression force created by rotation of said upper part in relation to said lower part.

7. A packer assembly for use in a well mining operation comprising:

an elongated packer body having a central opening extending through substantially entire length of the packer body, an upper part and a lower part;

a centralizer element detachably secured to the lower part of the packer body, said centralizer element comprising a plurality of resilient members secured on an exterior surface of an elongated mandrel, said resilient member being adapted to frictionally engaged an inner wall of a pipe which receives the packer assembly;

at least one flexible resilient annular collar mounted between said upper part and said lower part of the packer body, said collar increasing its diameter in response to a compression force created by rotation of said upper part in relation to said lower part, while said resilient members prevent rotation of said lower part when torque is applied to said upper part by frictionally engaging the inner wall of the pipe; and a pressure valve mounted in a top of said central opening to prevent escape of a downhole pressure.

8. The assembly of claim 7, wherein each of said resilient members comprises an arcuate leaf spring extending along substantially entire length of said mandrel.

9. A packer assembly for use in a well mining operation, comprising:

an elongated packer body having an upper part and a lower part;

a centralizer element detachably secured to the lower part of the packer body, said centralizer element comprising a plurality of resilient members secured on an exterior surface of an elongated mandrel, said resilient members being adapted to frictionally engage an inner wall of a pipe which receives the packer assembly;

at least one flexible resilient annular collar mounted between said upper part and said lower part of the packer body, said collar increasing its diameter in response to a compression force created by rotation of said upper part in relation to said lower part, while said resilient members resist rotation of said lower part by frictionally engaging the inner wall of the pipe;

a pressure valve mounted in the upper part of the packer body to prevent escape of a downhole pressure, and wherein said pressure valve comprises a cylindrical body having a central aperture extending therethrough, a spherical valve member mounted in said central aperture and a compression spring urging said valve member into a normally seated position against a valve seat formed on an inner wall of the central aperture of the valve body.

10. The assembly of claim 7, comprising a pair of flexible resilient annular collars mounted in a spaced-apart relationship between said upper part and said lower part of the packer body and retained in their spaced-apart relationship by a reduced diameter spacer member.

11. A retrievable safety packer assembly for use in a cement-lined pipe, the assembly comprising:

a packer body comprising an elongated mandrel having a central opening extending therethrough, an upper part mounted in a threadable engagement about at least a portion of said mandrel, a lower part mounted in a threadable engagement about a portion of the mandrel a distance from said upper part, a pair of flexible resilient annular collars mounted above said mandrel between said upper part and said lower part, said collars increasing their diameter in response to a compression force created by rotation of said upper part in relation to said lower part;

a normally seated pressure valve secured in the top portion of said central opening of the packer body, said pressure valve preventing escape of a downhole pressure, said pressure valve comprising a cylindrical valve body having a central aperture in axial alignment with the central opening of the mandrel, a spherical valve element in said central aperture and a compression spring urging said valve element into a seated position normally closing said aperture; and a centralizer element detachably secured to the lower part of the packer body, said centralizer element frictionally contacting an inner wall of said pipe to prevent rotation of said lower part of the packer body when torque is applied to the upper part of the packer body.

12. The assembly of claim 11, wherein said centralizer element comprises a plurality of equidistantly spaced resilient members secured about an exterior surface of an elongated centralizer body and extending along substantially entire length of the centralizer body.

13. The assembly of claim 12, wherein each of said resilient members comprises an arcuate leaf spring.

* * * * *